US006615953B1

(12) United States Patent
Steinweg

(10) Patent No.: US 6,615,953 B1
(45) Date of Patent: Sep. 9, 2003

(54) CONSTRUCTION HOIST WITH OPTICAL MONITORING DEVICE

(75) Inventor: Klaus Steinweg, Münster (DE)

(73) Assignee: Herman Steinweg GmbH & Co. KG Baumaschinenfabrik, Werne (DE)

( * ) Notice: Subject to any disclaimer, the term of this patent is extended or adjusted under 35 U.S.C. 154(b) by 0 days.

(21) Appl. No.: 09/634,429

(22) Filed: Aug. 8, 2000

Related U.S. Application Data

(63) Continuation of application No. PCT/EP99/00535, filed on Jan. 27, 1999.

(30) Foreign Application Priority Data

Feb. 7, 1998 (DE) ..... 298 02 089 U

(51) Int. Cl.[7] ..... B66B 1/28
(52) U.S. Cl. ..... 187/393; 187/314; 187/300
(58) Field of Search ..... 187/300, 313, 187/314, 316, 317, 391, 393

(56) References Cited

U.S. PATENT DOCUMENTS

| | | | | | |
|---|---|---|---|---|---|
| 4,479,053 | A | * | 10/1984 | Johnston | 250/221 |
| 4,644,329 | A | * | 2/1987 | Brueske | 340/556 |
| 4,839,631 | A | * | 6/1989 | Tsuji | 340/541 |
| 4,893,005 | A | * | 1/1990 | Stiebel | 250/211 |
| 4,942,385 | A | * | 7/1990 | Kobayashi et al. | 340/556 |
| 5,015,840 | A | * | 5/1991 | Blau | 250/221 |
| RE33,668 | E | * | 8/1991 | Gray | 250/221 |
| 5,149,921 | A | * | 9/1992 | Picado | 187/130 |
| 5,283,400 | A | * | 2/1994 | Leone et al. | 187/140 |
| 5,644,111 | A | * | 7/1997 | Cerny et al. | 187/393 |
| 6,138,798 | A | * | 10/2000 | Macuga | 187/294 |

FOREIGN PATENT DOCUMENTS

| | | |
|---|---|---|
| DE | 1961330 A1 | 10/1996 |
| JP | 07089680 A1 | 4/1995 |

OTHER PUBLICATIONS

Langer, Waldemar: "Unfallschutz an Lastenaufzugen [Accident prevention for freight elevators]" in Liftreport, 22 year (1996), vol. 2, Mar./Apr., 1996, pp. 9, 10].
F+H Report (Oct., 1994), pp. 46, 48, "Programmable laser scanner revolutionizes accident prevention").

* cited by examiner

*Primary Examiner*—Jonathan Salata
(74) *Attorney, Agent, or Firm*—Katten Muchin Zavis Rosenman

(57) ABSTRACT

The invention relates to a building elevator having an elevator mast, which can be set up vertically, and having an elevator car which can be moved in the vertical direction along the elevator mast and has a least one motor drive with control means, and said building elevator is intended to be developed further such that it is ensured, in the simplest possible manner, that it is not possible for any individual or objects to be situated beneath the elevator car during the downward travel of the elevator car.

10 Claims, 1 Drawing Sheet

CONSTRUCTION HOIST WITH OPTICAL MONITORING DEVICE

This application is a continuation division of international application number PCT(EP) 99/00535, filed Jan. 27, 1999.

STATEMENT REGARDING FEDERALLY SPONSORED RESEARCH AND DEVELOPMENT

Not Applicable

REFERENCE TO "MICROFICHE APPENDIX"

Not Applicable

BACKGROUND OF THE INVENTION

1. Field of the Invention

The invention relates to a building elevator having an elevator mast, which can be set up vertically, and having an elevator car which can be moved in the vertical direction along the elevator mast and has at least one motor drive with control means.

2. Description of Related Art Including Information Disclosed under 37 CRF 1.97 and 1.98.

Building elevators of this type are known as passenger elevators or as freight elevators, the elevator cars being configured differently in dependence on the carrying load (individuals or freight). It is usually the case that the elevator mast is to be anchored on the ground surface at the set-up location, for which purpose it is equipped with an elevator platform which usually comprises a frame and is set up on the ground surface and, if appropriate, anchored.

For safety reasons, it is absolutely necessary for the space beneath the elevator car, i.e. above the elevator platform, to be secured, in order to avoid the situation where an individual or else objects is/are situated beneath the elevator car when the elevator car moves downward. For this purpose, the elevator platform is usually provided with a fencing-like perimeter protector which bars access to the platform if the elevator car is not situated in its lowermost position. Such a building elevator is known, for example, from DE 196 13 308 A1.

However, such an elevator-platform perimeter protector involves relatively high outlay, that is to say during both construction and dismantling of such a building elevator, and it may also make access to the elevator car more difficult, in particular if the elevator car is designed as a freight carrier. In addition, it is necessary to provide different sizes of perimeter protector for different sizes of elevator cars and elevator-car platforms.

In the case of elevators in buildings which can be moved within an elevator shaft, it is known to arrange, in the region of the door opening, a vertically directed light-emitting grille which covers the door passage in order to ensure that it is not possible for either individuals or objects to be situated in the region of the door opening when the elevator car is traveling (LANGER, Waldemar: Unfallschutz an Lastenaüfzugen. [Accident protection for freight elevators] In: LIFT-REPORT, 22nd year, 1996, No. 2, March/April, 1996, pages 109, 110). A similar solution is known from JP 070 89 680 A.

The periodical F+H-Report 1994, October, pages 46, 48 "Programmierbarer Laser-Scanner revolutioniert den Unfallschutz" [Programmable laser scanner revolutionizes accident protection] discloses an optoelectronic protection system for monitoring the space in front of dangerous machine tools or the like. This protection system serves for monitoring the access region to a machine otherwise protected by a perimeter protector.

The object of the invention is to develop a building elevator further such that it is ensured, in the simplest possible manner, that it is not possible for any individuals or objects to be situated beneath the elevator car during downward travel of the elevator car.

BRIEF SUMMARY OF THE INVENTION

This object is achieved according to the invention, by a building elevator of the type described in the introduction, in that said building elevator is equipped with an optical monitoring device which monitors the space above the elevator platform set up on a ground surface and is connected to the control means of the motor drive such that the motor drive can be stopped, at least during downward travel of the elevator car, when the space above the elevator platform is not free.

A building elevator equipped in this way means that the need for a high-outlay perimeter protector for the elevator platform can be dispensed with completely. All that is necessary is to provide suitable optical monitoring devices on the borders of the elevator platform, or on the elevator car itself, these devices monitoring as to whether individuals or objects are situated in the space above the elevator platform, and the monitoring device being suitably connected to the control means of the motor drive such that the elevator car is immediately stopped, during downward travel, when individuals or objects are situated beneath the elevator car.

A particularly preferred embodiment is distinguished in that the monitoring device is formed by light barriers, which are preferably designed as infrared light barriers.

In order to ensure particularly reliable monitoring of the space above the elevator platform, it is advantageously provided that the light barriers are arranged at least in certain areas around the outer border of the elevator platform. It may already be sufficient here for light barriers to be provided on two opposite outer edges of the elevator platform.

Provision is made, particularly advantageously in design terms, for the light barriers to be integrated in a frame element which is fastened on the border of the elevator platform. This also makes it possible for existing building elevators to be retrofitted particularly easily simply by a corresponding frame element equipped with light barriers being fitted on the border of the elevator platform.

Alternatively, provision can also be made for light barriers to be integrated in the elevator car.

Instead of light barriers, it is also possible to use at least one laser scanner as the optical monitoring device. Such a laser scanner is known, for example, from the periodical F+H-Report 1994, October, pages 46, 48 "Programmierbarer Laser-Scanner revolutioniert den Unfallschutz" [Programmable laser scanner revolutionizes accident protection].

BRIEF DESCRIPTION OF SEVERAL VIEWS OF THE DRAWINGS

The invention is explained in more detail by way of example hereinbelow with reference to the drawing, in which.

DETAILED DESCRIPTION OF THE INVENTION

Figure 1:
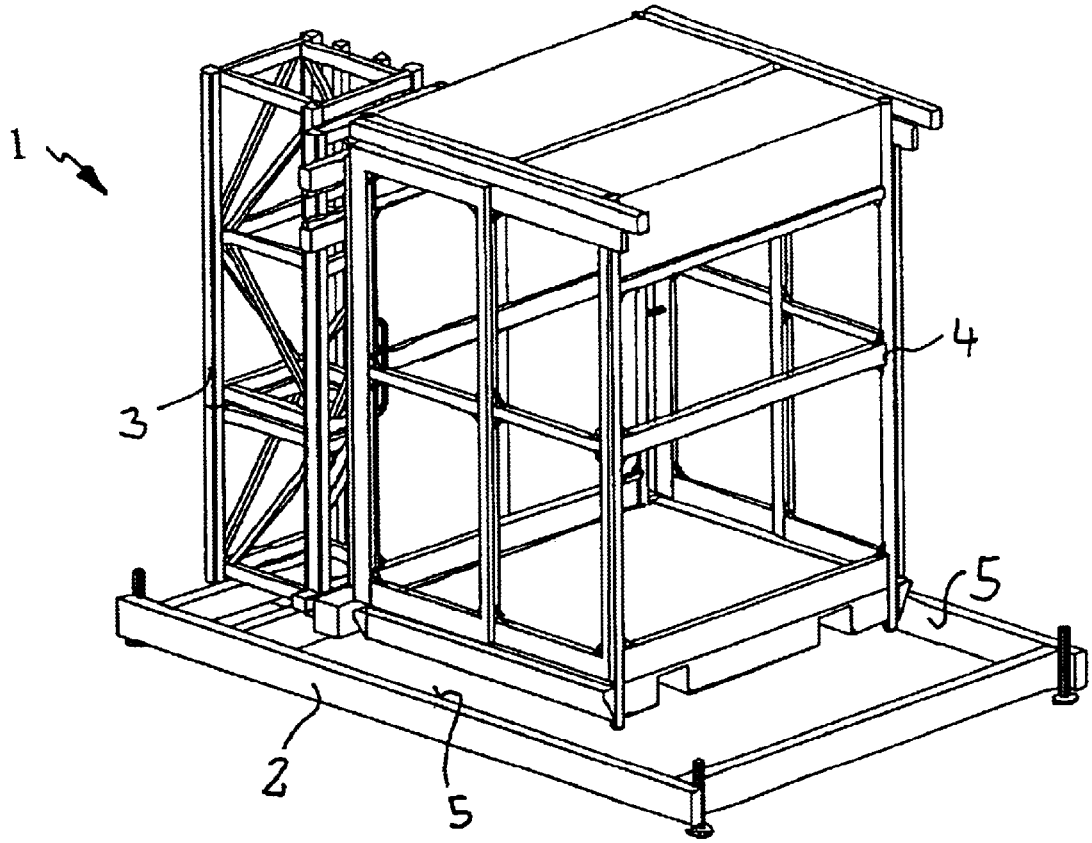
FIG. 1 shows a perspective illustration of one configuration of a building elevator according to the invention.

A building elevator is illustrated merely with the parts essential for the invention, and is designated in general terms by 1, in FIG. 1. Said building elevator 1 first of all has an elevator platform 2 which is to be set up on the ground surface at the set-up location on the building site or the like, which comprises a basic frame and on which there is arranged, preferably in a corner region, an elevator mast 3 which may be configured in a wide range of different ways, which will not be discussed in any more detail here. The mast preferably comprises a plurality of individual elements, in order for it to be possible for the height of the mast to be easily adapted to the respective use purpose.

An elevator car 4 can be moved along said elevator mast 3, the elevator car, in the case of the exemplary embodiment illustrated, being designed as a closed passenger elevator car. For the purpose of moving the elevator car 4 in the vertical direction along the elevator mast 3, it is possible for the elevator mast 3 to be equipped, for example, with a rack and for the elevator car 4 to be equipped with a motor drive (not illustrated) which is designed as a geared motor and has a corresponding control means.

For safety reasons, it has been necessary up until now to provide the elevator platform 2 all round with a fencing-like perimeter protector in order to ensure that there are no objects or individuals situated in the space beneath the elevator car 4 at least during downward travel of the elevator car 4. In the case of the configuration of the building elevator 1 according to the invention, this perimeter protector is not necessary. This is because the invention provides for the building elevator 1 to be equipped with an optical monitoring device which monitors the space above the elevator platform 2. In the case of the exemplary embodiment according to FIG. 1, this monitoring device is formed by two light barriers 5 which are arranged on two opposite outer edges of the elevator platform 2. Said light barriers 5 are preferably designed as infrared light barriers. Said light barriers 5 are suitably connected, in a manner known per se, to the control means of the motor drive 7 of the elevator car 4. If the light barriers 5 establish, during downward travel of the elevator car 4, that individuals or objects are situated above the elevator platform 2, the control means of the motor drive is activated such that the elevator car 4 and/or the motor drive 7 thereof is immediately stopped and the elevator car 4 cannot move any further in the downward direction. This is only possible again when the space above the elevator platform 2 is free again.

Figure 2:
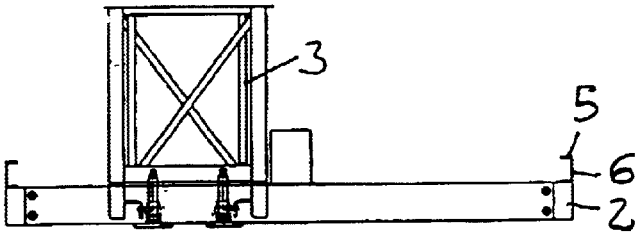
FIG. 2 shows a side view of a building elevator which is illustrated without a car.
Figure 3:
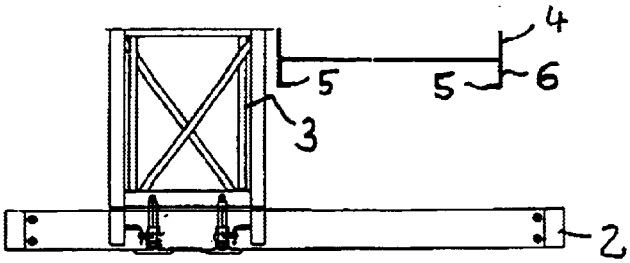
FIG. 3 is a cross-sectional partial view of the invention.

As FIG. 2 shows, the light barriers 5 are preferably integrated in a frame element 6, which can easily be fastened on the border of the elevator platform 2, which also allows existing building elevators to be retrofitted particularly easily.

Alternatively, it may also be provided that the light barriers 5, rather than being arranged on the elevator platform 2, are integrated in the elevator car 4. This is not illustrated in the drawing.

Of course, the invention is not restricted to the exemplary embodiments illustrated. Further configurations are possible without departing from the basic idea. Thus, of course, the configuration of the building elevator 1 according to the invention is suitable not just for passenger elevators but also for freight elevators, in the case of which the elevator car 4 is usually configured differently, Instead of using the above-described light barriers 5 as the optical monitoring device, it is also possible to use at least one laser scanner, which is not illustrated in the drawings.

What is claimed is:

1. A building elevator having an elevator mast, which can be set up vertically, and having an elevator car which can be moved in the vertical direction along the elevator mast and has at least one motor drive with control means, said building elevator (1), comprising:

an optical monitoring device which monitors space above the elevator platform set up on a ground surface a control means of the motor drive wherein send optical monitoring device is connected to the control means wherein the motor drive can be stopped, at least during downward travel of the elevator car, when the space above the elevator platform is not free.

2. The building elevator as claimed in claim 1, wherein the monitoring device is formed by light barriers.

3. The building elevator as claimed in claim 2, wherein the light barriers are designed as infrared light barriers.

4. The building elevator as claimed in claim 2, wherein the light barriers are arranged around an outer border of the elevator platform.

5. The building elevator as claimed in claim 4, wherein the light barriers are provided on two opposite outer edges of the elevator car.

6. The building elevator as claimed in claim 4, wherein the light barriers are integrated in a frame element which is fastened on the border of the elevator platform.

7. The building elevator as claimed in 2, wherein the light barriers are integrated in the elevator car.

8. The building elevator as claimed in claim 1, wherein the optical monitoring device is formed by at least one laser scanner.

9. The building elevator as claimed in claim 3, wherein the light barriers are integrated in the elevator car.

10. The building elevator as claimed in claim 3, wherein the light barriers are integrated in the elevator car.

* * * * *